US009664194B2

(12) United States Patent
Oleson

(10) Patent No.: US 9,664,194 B2
(45) Date of Patent: May 30, 2017

(54) CEILING FAN WITH MOISTURE PROTECTION FEATURES

(71) Applicant: DELTA T CORPORATION, Lexington, KY (US)

(72) Inventor: Richard A. Oleson, Lexington, KY (US)

(73) Assignee: DELTA T CORPORATION, Lexington, KY (US)

( * ) Notice: Subject to any disclaimer, the term of this patent is extended or adjusted under 35 U.S.C. 154(b) by 220 days.

(21) Appl. No.: 14/286,580

(22) Filed: May 23, 2014

(65) Prior Publication Data

US 2014/0348649 A1 Nov. 27, 2014

Related U.S. Application Data

(60) Provisional application No. 61/827,291, filed on May 24, 2013.

(51) Int. Cl.

| | |
|---|---|
| ***F04D 19/00*** | (2006.01) |
| ***F04D 25/08*** | (2006.01) |
| ***F04D 29/32*** | (2006.01) |
| ***F04D 29/08*** | (2006.01) |
| *F04D 29/70* | (2006.01) |
| *F04D 29/58* | (2006.01) |
| *F04D 29/64* | (2006.01) |

(52) U.S. Cl.

CPC ..... *F04D 19/002* (2013.01); *F04D 25/08* (2013.01); *F04D 25/082* (2013.01); *F04D 25/088* (2013.01); *F04D 29/083* (2013.01); *F04D 29/329* (2013.01); *F04D 29/582* (2013.01); *F04D 29/646* (2013.01); *F04D 29/701* (2013.01)

(58) Field of Classification Search

CPC .... F04D 25/088; F04D 29/083; F04D 19/002; F04D 25/08; F04D 25/082; F04D 29/329; F04D 29/582; F04D 29/646; F04D 29/701

See application file for complete search history.

(56) References Cited

U.S. PATENT DOCUMENTS 4,325,149 A 4/1982 Moreland
4,592,702 A * 6/1986 Bogage ..... F04D 25/088 310/89

(Continued)

FOREIGN PATENT DOCUMENTS

EP 1312805 A1 5/2003

OTHER PUBLICATIONS

KEEA Keystone Energy Efficiency Alliance Ceiling Fans Retrieved from http://energywisepa.org/category/fact-sheet-categories/cooling/ceiling-fans/ceiling-fans.

*Primary Examiner* — Dominick L Plakkoottam
(74) *Attorney, Agent, or Firm* — King & Schickli, PLLC

(57) ABSTRACT

A fan may be designed for the strategic diversion of moisture through or around a housing enclosing a controller and/or a motor. The enclosure may include one or more paths for directing moisture away from the controller or the motor. For instance, the housing may include a gap between a support structure and the housing for preventing moisture from entering the housing. The housing may also include a hollow structure for directing fluid through the housing. Additionally, the housing may include one or more channels, raised walls, gutters, and shields for preventing fluid, such as liquid water, from entering an enclosure for the controller or motor.

13 Claims, 5 Drawing Sheets

(56) References Cited

U.S. PATENT DOCUMENTS

| | | | | | |
|---|---|---|---|---|---|
| 4,626,720 | A | | 12/1986 | Fukasaku et al. | |
| 4,863,346 | A | * | 9/1989 | Lin | H02K 5/20 416/5 |
| 5,135,365 | A | * | 8/1992 | Bogage | F04D 29/083 416/244 R |
| 5,489,191 | A | * | 2/1996 | Tai | F04D 29/646 416/5 |
| 5,507,619 | A | | 4/1996 | Ryan | |
| 5,562,421 | A | | 10/1996 | Huang | |
| 5,586,871 | A | * | 12/1996 | Barnes | F04D 29/083 415/173.7 |
| 5,716,200 | A | | 2/1998 | Mirumachi et al. | |
| 5,900,686 | A | | 5/1999 | Tabata et al. | |
| 5,934,869 | A | | 8/1999 | Janisse | |
| 6,443,714 | B1 | * | 9/2002 | Hollenbeck | F04D 25/08 417/423.1 |
| 6,477,321 | B2 | * | 11/2002 | Reiker | F04D 25/088 392/364 |
| 6,703,730 | B2 | | 3/2004 | Hayashi | |
| 6,916,160 | B2 | | 7/2005 | Obara | |
| 7,367,201 | B1 | | 5/2008 | Doring et al. | |
| 7,594,798 | B1 | | 9/2009 | Bucher et al. | |
| 2009/0208333 | A1 | | 8/2009 | Smith et al. | |
| 2011/0165002 | A1 | | 7/2011 | Noble | |
| 2013/0038255 | A1 | | 2/2013 | Trainque | |
| 2013/0280077 | A1 | * | 10/2013 | Iwamoto | F04D 25/088 416/204 R |

* cited by examiner

CEILING FAN WITH MOISTURE PROTECTION FEATURES

This application claims priority to U.S. Provisional Patent Application No. 61/827,291, filed May 24, 2013, the disclosure of which is incorporated herein by reference.

TECHNICAL FIELD

This application relates generally to the air handling arts and, more particularly, to a ceiling fan with moisture protection features.

BACKGROUND OF THE INVENTION

Fans and, in particular, ceiling fans, are often used in environments that may subject sensitive components to moisture, such as in an outdoor environment. Many past efforts have focused on ways to preclude moisture from entering the fan in an effort to prevent failure and extend the service life, such as by using seals or hermetically enclosed spaces for containing moisture-sensitive components. Aside from increasing the cost and complexity of manufacture and maintenance, these approaches foreclose proper ventilation of the component parts, which may be necessary to ensure efficient operation and prevent deleterious overheating.

Consequently, a need is identified for a fan arrangement that provides for moisture control in a manner that does not impact adequately ventilating parts of the fan that may benefit from such ventilation.

SUMMARY OF THE INVENTION

In one embodiment, the disclosure pertains to an apparatus for circulating air, comprising a rotatable hub including a plurality of blades, a motor for rotating the hub, a controller for controlling the motor, and a housing for housing the motor and controller, the housing including at least one strategic path for directing liquid away from the motor and the controller. The strategic path may be at least partially internal to the housing.

In a first aspect, the strategic path may include a gap between an upper structure of the housing and a lower structure of the housing. The upper structure and the lower structure may include vertical walls that may be parallel to one another. In one aspect, the lower structure may include an annular ring or wall extending upward from a surface to create the gap with the upper structure.

In another aspect, the strategic path may include a hollow tube adapted to direct water through the housing to a lower surface of the housing. The lower surface of the housing may include a drain for allowing water to exit the housing. The hollow tube may include an aperture at the bottom of the tube, said aperture open to the lower surface of the housing.

In a further aspect, the strategic path may include one or more elements adapted to direct water from a position radially inward from the one or more elements to a position radially outward from the one or more elements. The one or more elements may include radial extending walls, radial channels, a raised annular wall, a gutter, or any other element for directing the flow of water radially outward. These one or more elements may comprise part of the housing. In one aspect, the one or more elements may be within the housing.

The housing may comprise a first enclosure for enclosing the controller. The controller may be mounted within an upper portion of the first enclosure. Furthermore, the first enclosure may include a passage forming a portion of the at least one path for directing liquid away from the motor and controller.

Additionally, the housing may include a second enclosure for enclosing the motor, the second enclosure including a casing having a plurality of radially extending channels forming a portion of the at least one path for directing liquid away from the motor. The casing may include at least one opening for ventilating the second enclosure, wherein the casing includes a projection for preventing liquid from entering the at least one openings. In one aspect, the casing may include a plurality of circumferentially spaced openings for ventilating the second enclosure, wherein the casing includes a projection for preventing liquid from entering each of the openings.

The motor may comprise a stator and a rotor located within the second enclosure, and wherein the rotor is connected to the casing. Additionally, the casing may be connected to the hub.

The housing may further include a support for supporting the fan from a stable support structure, wherein the support includes a portion of the strategic flow path. In one aspect, the support may be adapted to direct fluid to flow external to the housing. In another aspect, the support may be adapted to direct fluid flow to a drain within the housing.

The enclosure for the motor may additionally include a circumferential opening and a shield spaced from the opening for preventing spraying liquid from entering the enclosure.

In another embodiment an apparatus for driving a fan including a plurality of blades is disclosed, said apparatus comprising a motor for rotating the plurality of blades about an axis of rotation, and a housing for housing the motor, the housing including a casing having a plurality of channels adapted for directing liquid contacting the casing in a radial direction. The motor may include a rotor and a stator within the housing, wherein the rotor is connected to the casing. The channels may be formed by pairs of upstanding, radially extending walls. The casing may further include a plurality of openings for ventilating the housing, and wherein each opening is adapted for preventing liquid from entering the housing.

In a further embodiment, a rotatable motor enclosure is disclosed, comprising a casing including a plurality of openings with parapets. The enclosure may further include a gutter in the casing for guiding fluid away from the openings.

Another embodiment disclosed herein relates to an apparatus for driving a fan including a plurality of blades, said apparatus including a controller for controlling the driving of the fan, and an enclosure for enclosing the controller, said enclosure including at least one opening, wherein the controller is located in an upper portion of the enclosure in a manner that prevents any liquid entering the opening from reaching the controller. The controller may be mounted above the opening, and may be mounted adjacent to a ceiling of the enclosure. The controller may take the form of a printed circuit board. In one aspect, the enclosure may include a drain.

In a further embodiment, a ceiling fan is disclosed, having a housing including a drain for draining liquid entering the housing. The housing may comprise an electronics enclosure. The housing may also include a motor enclosure. Said housing may be rotatable in nature. The drain of the housing may be formed by a peripheral opening in a lower portion of a motor housing, and the housing may further include a shield for shielding the opening from spraying liquid without preventing ventilation of the interior space of the housing.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

DETAILED DESCRIPTION

Figure 1:
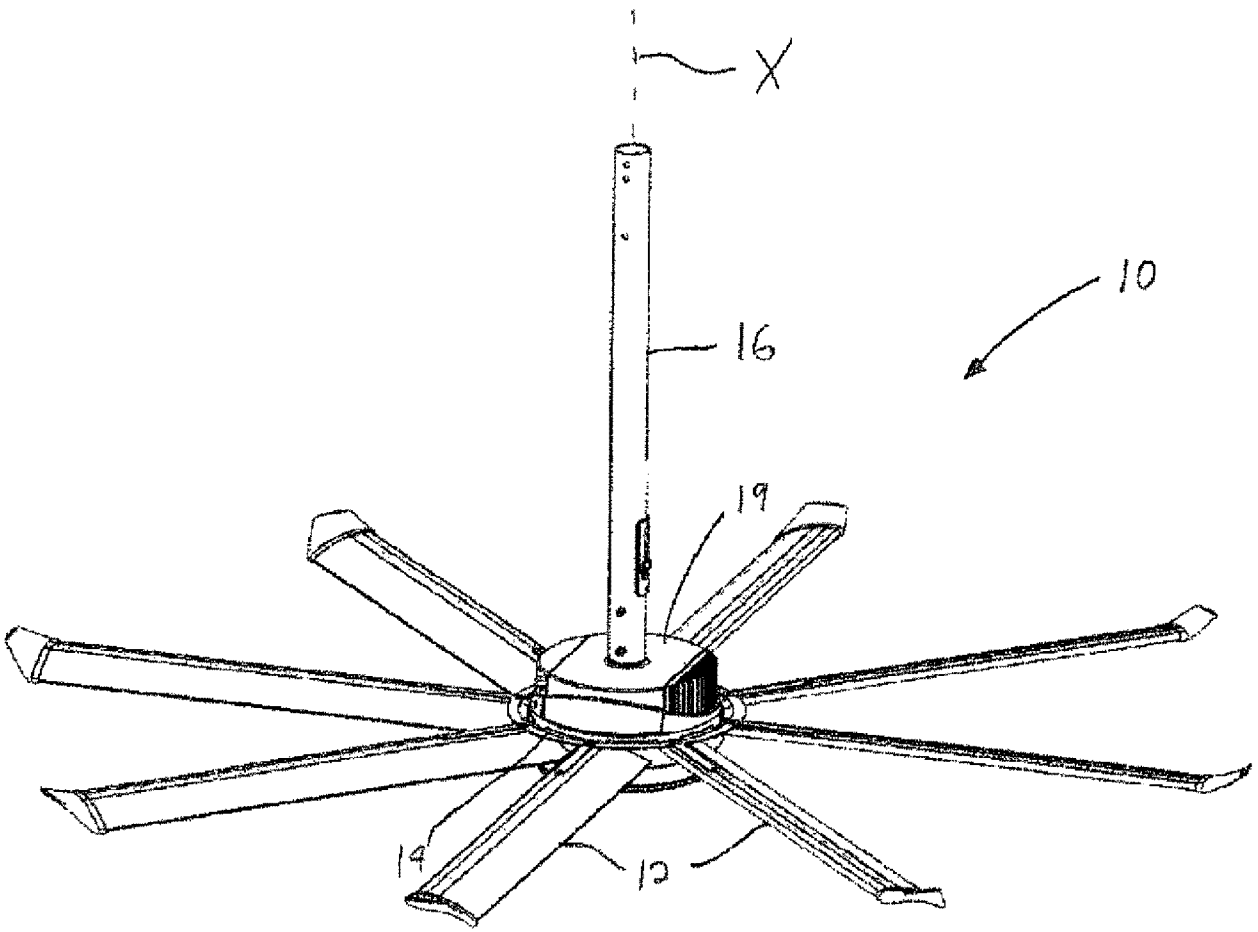
FIG. 1 is a perspective view of an exemplary fan having a housing, a rotatable hub, a plurality of blades, and a motor for rotating the hub.

Reference is now made to FIG. 1, which illustrates one possible embodiment of a fan 10 having improved moisture control according to the present disclosure. The fan 10 includes a plurality of blades 12, such as ten in the illustrated example, but any number of blades may be provided depending on the particular application. The blades 12 are attached to and extend generally radially from a hub 14, and may be equidistantly or irregularly spaced. The hub 14, in turn, is connected to a support 16, such as an elongated tube, for supporting the fan 10 from a stable support structure, such as the ceiling of a room, and in a manner that permits rotation of the blades 12 about a generally vertical axis X of rotation in order to generate airflow. The support 16 may be arranged to accommodate wiring or the like for electronic components carried by the fan 10, such as for example a light, sensor, camera, or the like, such as through a tubular passage.

Figure 2:
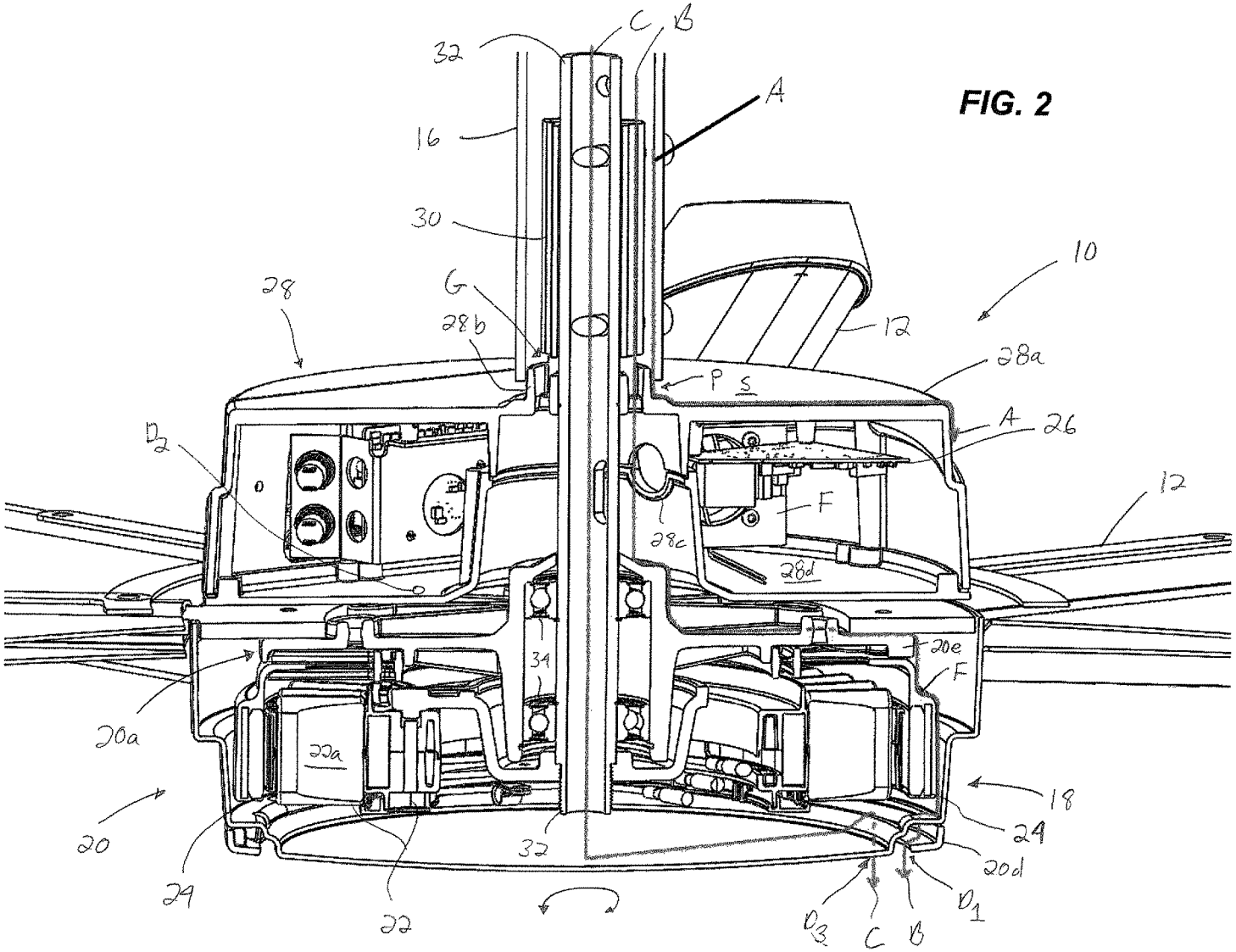
FIG. 2 is a perspective sectional view of a fan with one or more strategic paths for diverting water.

Turning to FIG. 2 as well, the fan 10 may be associated with a drive in order to impart rotary motion to the blades 12. In one embodiment, this drive may comprise a motor 18 housed within a housing 19 connected to the support 16, which motor serves to rotate the hub 14. The motor 18 in the illustrated embodiment may comprise a non-contact drive arrangement in which a stationary stator 22 forms a magnetic coupling with a rotor 24, which may be connected to the support, or shaft 16. The stator 22 may comprise a plurality of circumferentially spaced poles 22*a*, which may include windings. When selectively electrified by way of a controller 26 in the enclosure 28 and communicating with a power source (not shown) through suitable transmission lines, such as wires (which as discussed below may pass through the tubular support 16), the poles of stator 22 create a magnetic field that induces rotation in the rotor 24, which may comprise a plurality of magnets of alternating polarity. As a result, the hub 14 and thus the blades 12 are caused to rotate and circulate the air. However, the particular form of the motor 18 used in connection with fan 10 is not considered important, and could take various forms.

In the illustrated embodiment, the housing 19 comprises a first enclosure 20 for substantially enclosing the motor 18 for causing the associated hub 14 to rotate, and a second, adjacent enclosure 28 for substantially enclosing the electronics (including, for example, controller 26) for controlling the motor 18. According to one aspect of the disclosure, this housing 19 is specially designed and arranged to accept and strategically divert any moisture that may enter into the support 16 or enclosures 20, 28, without sacrificing the desire for ventilation as may be necessary to maintain the optimal operating conditions to reduce maintenance and increase the service life. Part of this strategic effort involves providing one or more pre-determined paths for the controlled flow of any liquid entering the interior space of the support 16 or the housing 19 in a manner that protects the electronics, such as controller 26, or components or motor 18, is from the potentially harmful effects of wetness.

For instance, as shown in FIG. 1, a first controlled flow path labeled A is indicated, in which any liquid, including from condensation, present along the interior surface of the tubular support 16 is guided to the external upper surface S of the cover 28*a* forming part of the enclosure 28, and away from the enclosed spaces. This is facilitated by nesting a portion of the cover 28*a* of enclosure 28, such as lip 28*b*, within the proximal open end of the tubular support 16. Consequently, a peripheral gap P is formed that allows for the liquid to flow out along the cover 28*a* and thus away from the interior space of the enclosures 20, 28.

As should be appreciated, this arrangement may also create an interior gap G that allows for external connections, such as wiring, to pass through a multi-lobed guide 30 nested in the support 16. This guide 30 at least partially surrounds and may be concentric with a support extension 32 (which is shown as a hollow tube coaxial with and connected to support 16) for supporting the stator 22. As outlined in further detail below, this wiring (not shown for purposes of clarity) may extend from the guide 30 into the enclosure 28 housing the controller 26, and thus supply power to it. For example, the sidewall forming the interior surface of the enclosure 28 may include one or more apertures 28*c* for allowing for connections to be made between the wires passing through the guide 30 and gap G into communication with the controller 26.

Figure 3:
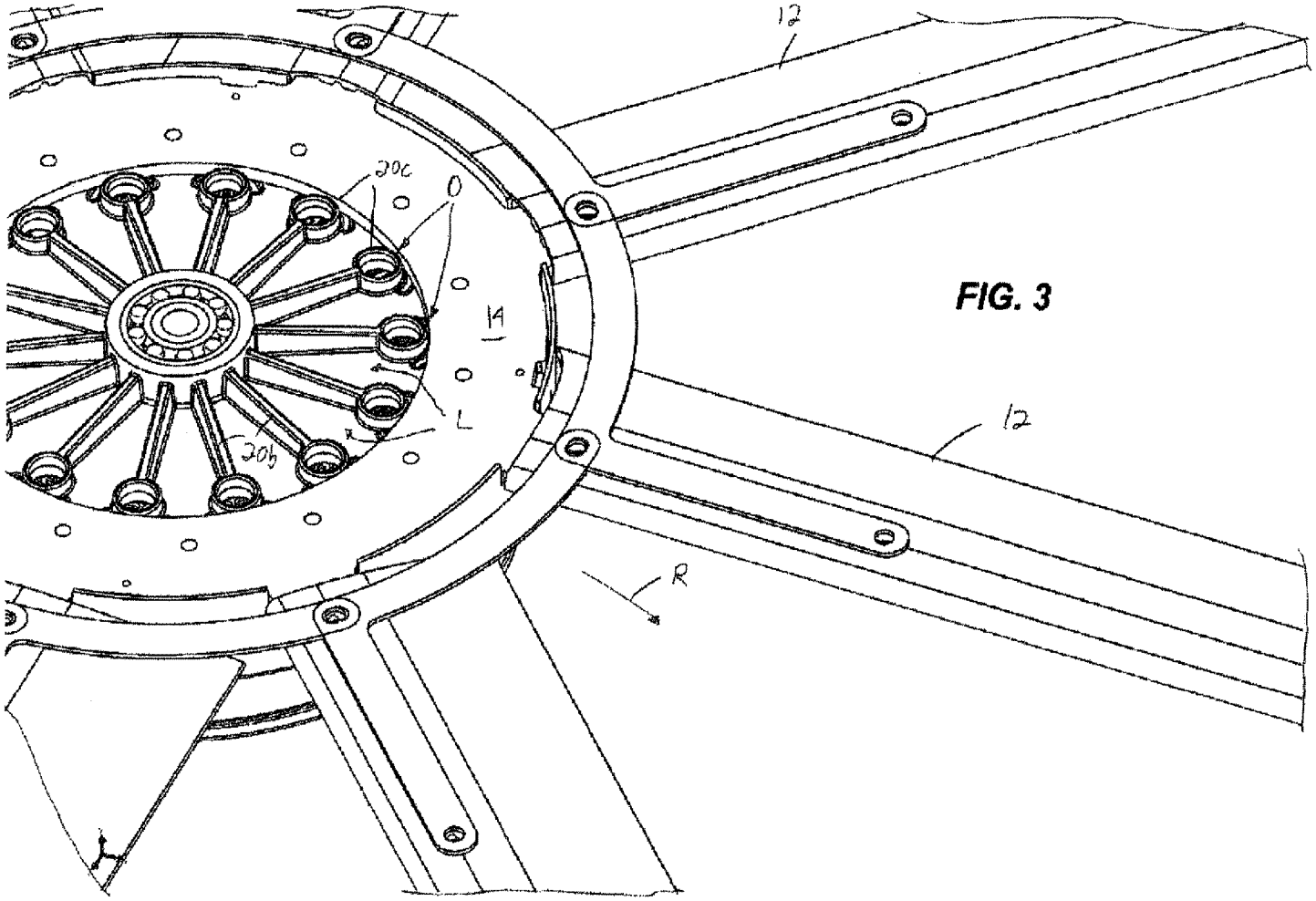
FIG. 3 is a perspective view of a portion of the housing of the fan of FIG. 2.

While this gap G allows for some desirable ventilation, the potential exists for moisture to pass into the space between the support extension 32 and the adjacent interior surface of the enclosure 28 as a consequence of this access. To address this potential ingress without impacting the desired ventilation, a second flow path B is designated whereby liquid in this space is directed along a casing 20*a* forming part of the second enclosure 20 for motor 18. Specifically, the casing 20*a* along an innermost portion houses the bearings 34 that facilitate rotation of the rotor 24 and thus hub 14 connected to it about the stationary support 32. This portion may be shaped in a manner to direct any liquid that does not follow flow path A (or path C, as discussed below) into radially extending channels L formed on the upper surface of the casing 20*a*. As perhaps best understood by viewing FIG. 3, these channels L may be formed by radially extending walls 20*b* projecting from the casing 20*a*. The walls 20*b*, which are shown as being divergent and also sloping in the radial direction R, thus form the sidewalls of each channels L. Together with the upper surface of the casing 20*a*, these walls 20*b* thus serve to guide any liquid in the radial direction R, including as the result of centrifugal force when the motor 18 is active and the casing 20*a* is thus rotating along with the hub 14. The liquid carried by these channels L may pass outwardly into the enclosure 20 in the radial direction, where it may flow along the outside of the rotor 24 (which is at least partially covered by the casing 20*a*), and escape through a drain D1.

Figure 4:
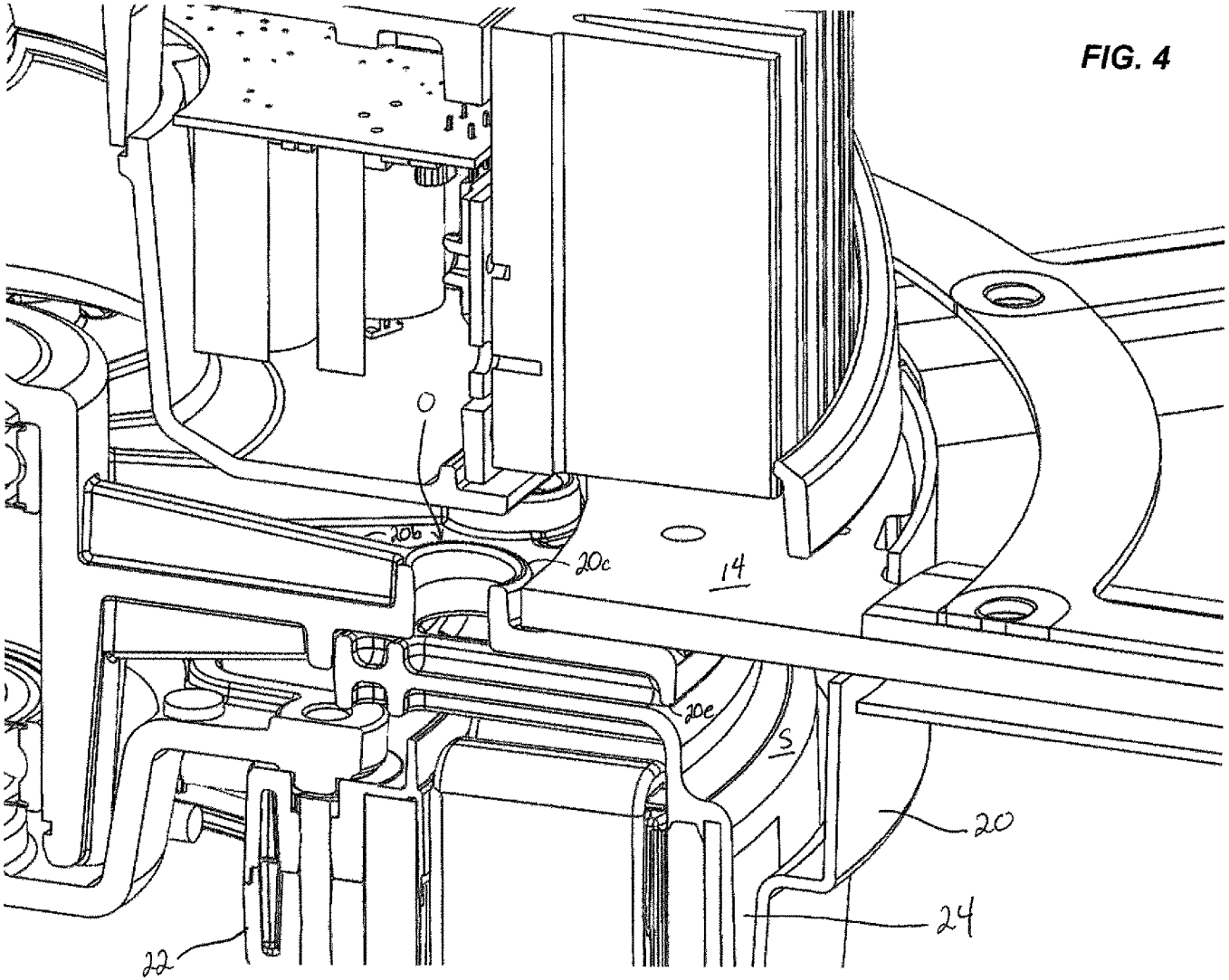
FIG. 4 is an additional perspective sectional view of the fan of FIG. 2.
Figure 4A:
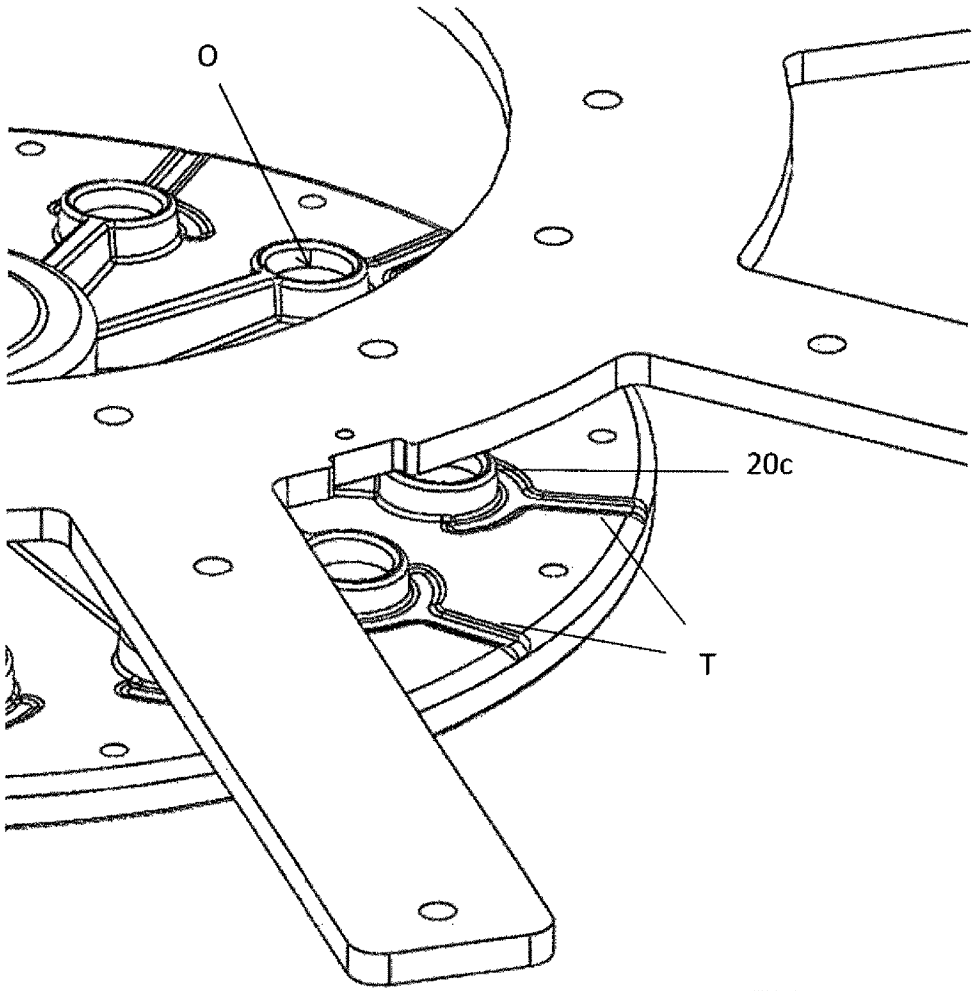
FIG. 4*a* is a perspective view of the casing of the fan of FIG. 2.

To facilitate the liquid movement into the enclosure 20, it can be appreciated from FIGS. 4 and 4*a* that gutters T may be provided in the surface of the casing 20*a* for receiving and guiding the liquid in the desired manner. Specifically, a gutter T may at least partially surround each wall 20*c* forming the parapet around opening O, and may include a radially extending leg to guide the fluid to a depending lip 20*e* of the casing 20*a*. As can be appreciated, this lip guides the liquid to an external surface S of the rotor 24, which shields the underlying stator 22 and magnets. The liquid may then flow along this external surface into the lower portion of enclosure to be released through drain D1.

In the illustrated embodiment, this drain D1 may take the form of one or more narrow peripheral openings in the lower portion of enclosure 20 and extending generally in the circumferential direction. The opening(s) may be guarded by a circumferentially extending shield 20*d* connected externally to the enclosure 20. The shield 20*d* is advantageously arranged to prevent spray from passing through this opening into the interior space containing the stator 22 and rotor 24, while allowing for the desirable ventilation to occur.

As can be further appreciated, the casing 20*a* may also desirably include openings O associated with each of the walls 20*b*, which provide the important function of helping to ventilate the enclosure 20 for the motor 18 (which may generate a significant amount of heat when operational). In order to ensure that liquid is guided in the intended manner along flow path B without entering the enclosure 22, these openings O may be surrounded by circumferential walls 20*c*, which may be co-extensive with the radially extending walls 20*b* forming the channels L. In the illustrated embodiment, the circumferential walls 20*c* may be circular, and thus may be considered to form parapets that protect against the ingress of liquid into the openings O, thereby guarding the adjacent stator 22 and rotor 24 while simultaneously allowing for the desired ventilation to be provided.

A further feature for protecting the fan 10 from moisture can be understood with reference back to FIG. 2. It can be seen that the controller 26, which may take the form of a printed circuit board (PCB), is mounted in the upper portion of the enclosure 28, such as adjacent to the ceiling of the corresponding enclosure 28. This mounting arrangement helps to ensure that relatively small amounts of liquid that somehow penetrate the enclosure 28 will not contact the controller 26. For example, if liquid were to flow along one or more connectors, such as wires, passing through aperture 28*c* into the electronics enclosure 28, it would tend to fall downwardly and away from the controller 26 as the result of gravitational forces. Indeed, it is possible to provide a drain D2 in the floor 28*d* of the enclosure 28 to allow for any accumulated liquid, including from condensation, to fall onto the adjacent casing 20*a* and thus be directed along flow path B in the manner previously described (see FIG. 4). In the illustrated embodiment, the enclosure 28 also includes a fan F for assisting in providing proper cooling and ventilation, which fan may also be mounted above the floor 20*d* to help guard against liquid contact during the above-described draining procedure.

A third controlled flow path C may also be provided by the support extension 32, which as noted and shown may be tubular. As can be appreciated by viewing FIG. 2, any liquid flowing within this support extension 32 is guided onto the floor 20*d* of enclosure 20, which again is rotatable. Hence, a drain D3 may also be provided for allowing this moisture to escape from the enclosure 20, which may be adjacent to the periphery in order to take advantage of centrifugal forces.

Having shown and described various embodiments, further adaptations of the apparatuses, methods and systems described herein may be accomplished by appropriate modifications by one of ordinary skill in the art without departing from the scope of the disclosure. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the disclosure should be considered in terms of claims that may be presented, and is understood not to be limited to the details of structure and operation shown and described in the specification and drawings.

The disclosure of U.S. Patent Application Publication Ser. No. 2010-0278637 is incorporated herein by reference.

The invention claimed is:

1. An apparatus for circulating air, comprising:

a rotatable hub including a plurality of blades;

a motor for rotating the hub;

a controller for controlling the motor; and a housing for housing the motor and controller, the housing including at least one strategic path for directing liquid away from the motor and the controller, wherein the housing includes a first enclosure for enclosing the controller and a second enclosure separate from the first enclosure for enclosing the motor;

wherein the housing includes a plurality of channels formed by pairs of upstanding, radially extending walls adapted for directing liquid contacting the housing in a radial direction, the housing further including a plurality of openings for ventilating the housing, each of the openings including a circumferential wall extending therefrom and configured to protect against the ingress of liquid into each of the openings; and wherein each of the circumferential walls is at least partially coextensive with at least one of the radially extending walls.

2. The apparatus of claim 1, wherein the controller is mounted within an upper portion of the first enclosure.

3. The apparatus of claim 1, wherein the first enclosure includes a passage forming a portion of the at least one path for directing liquid away from the motor and controller.

4. The apparatus of claim 1, wherein the motor comprises a stator and a rotor located within the second enclosure, and wherein the rotor is connected to the casing.

5. The apparatus of claim 1, wherein the housing is connected to the hub.

6. The apparatus of claim 1, wherein the housing includes a support for supporting the fan from a stable support structure, wherein the support includes a portion of the strategic path.

7. The apparatus of claim 6, wherein the support is adapted to direct fluid to flow external to the housing.

8. The apparatus of claim 6, wherein the support is adapted to direct fluid flow to a drain within the housing.

9. The apparatus of claim 6, wherein the housing includes a circumferential opening and a shield spaced from the opening for preventing liquid spray from entering the housing.

10. The apparatus of claim 6, wherein the support passes through a middle of the first and second enclosures and defines a portion of the strategic path therethrough.

11. An apparatus for driving a fan including a plurality of blades, comprising:

a motor for rotating the plurality of blades about an axis of rotation; and a housing for housing the motor, the housing including a casing having a plurality of channels adapted for directing liquid contacting the casing in a radial direction, the casing further including a plurality of openings for ventilating the housing, each of the openings including a circumferential wall extending therefrom and configured to protect against the ingress of liquid into each of the openings;

wherein the channels are formed by pairs of upstanding, radially extending walls; and wherein each circumferential wall is at least partially coextensive with one of the radially extending walls.

12. The enclosure of claim 11, further including a gutter at least partially surrounding each circumferential wall extending from each of the plurality of openings in the casing for guiding fluid away from the openings.

13. An apparatus for driving a fan including a plurality of blades, comprising:

a controller for controlling the driving of the fan; and an enclosure for enclosing the controller, said enclosure including at least one opening;

wherein the controller is located in an upper portion of the enclosure above the opening in a manner that prevents any liquid entering the opening from reaching the controller;

wherein the enclosure includes a plurality of channels, the channels formed by pairs of upstanding, radially extending walls adapted for directing liquid contacting the enclosure in a radial direction, the enclosure further including a plurality of openings for ventilating the enclosure, each of the openings including a circumferential wall extending therefrom and configured to protect against the ingress of liquid into each of the openings; and wherein each of the circumferential walls is at least partially coextensive with one of the radially extending walls.

* * * * *